US008836205B2

(12) United States Patent
Hashimoto

(10) Patent No.: US 8,836,205 B2
(45) Date of Patent: Sep. 16, 2014

(54) CYCLOTRON

(71) Applicant: Sumitomo Heavy Industries, Ltd., Tokyo (JP)

(72) Inventor: Atsushi Hashimoto, Yokosuka (JP)

(73) Assignee: Sumitomo Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/906,817

(22) Filed: May 31, 2013

(65) Prior Publication Data

US 2013/0328475 A1 Dec. 12, 2013

(30) Foreign Application Priority Data

Jun. 1, 2012 (JP) ..... 2012-126100

(51) Int. Cl.
*H05H 13/00* (2006.01)

(52) U.S. Cl.
CPC ..... *H05H 13/005* (2013.01)
USPC ..... 313/47; 313/62

(58) Field of Classification Search
CPC ..... H01F 6/00; H01F 6/02; H01F 6/04; H01J 19/42; H01J 19/50; H01J 19/52
USPC ..... 313/27, 47, 62; 315/502; 335/216
See application file for complete search history.

(56) References Cited

U.S. PATENT DOCUMENTS 7,656,258 B1 * 2/2010 Antaya et al. ..... 335/216
2011/0193665 A1 * 8/2011 Huang et al. ..... 335/216

FOREIGN PATENT DOCUMENTS

JP 2002-043117 A 2/2002

* cited by examiner

*Primary Examiner* — Nimeshkumar Patel
*Assistant Examiner* — Steven Horikoshi
(74) *Attorney, Agent, or Firm* — Squire Patton Boggs (US) LLP

(57) ABSTRACT

A cyclotron includes a superconductive coil that is disposed in a vacuum vessel, a cooling unit that cools the superconductive coil, a basic support member that is installed in the vacuum vessel and supports the superconductive coil in the vacuum vessel, and a support member for quenching that is fixed to one of the superconductive coil and the vacuum vessel and forms a predetermined gap with the other thereof.

5 Claims, 3 Drawing Sheets

CYCLOTRON

INCORPORATED BY REFERENCE

Priority is claimed to Japanese Patent Application No. 2012-126100, filed Jun. 1, 2012, the entire content of each of which is incorporated herein by reference.

BACKGROUND

1. Technical Field

The present invention relates to a cyclotron which accelerates charged particles.

2. Description of the Related Art

A cyclotron in the related art includes a hollow yoke, a vacuum vessel disposed in an inner space of the yoke, a superconductive coil disposed in the vacuum vessel, and a refrigerator cooling the superconductive coil. In this cyclotron, the superconductive coil in the vacuum vessel is supported by rod-shaped members for supporting a horizontal load and supporting a vertical load.

SUMMARY

According to an embodiment of the present invention, there is provided a cyclotron including a superconductive coil that is disposed in a vacuum vessel; a cooling unit that cools the superconductive coil; a basic support member that is installed in the vacuum vessel and supports the superconductive coil in the vacuum vessel; and a support member for quenching that is fixed to one of the superconductive coil and the vacuum vessel and forms a predetermined gap with the other thereof.

DETAILED DESCRIPTION

Figure 1:
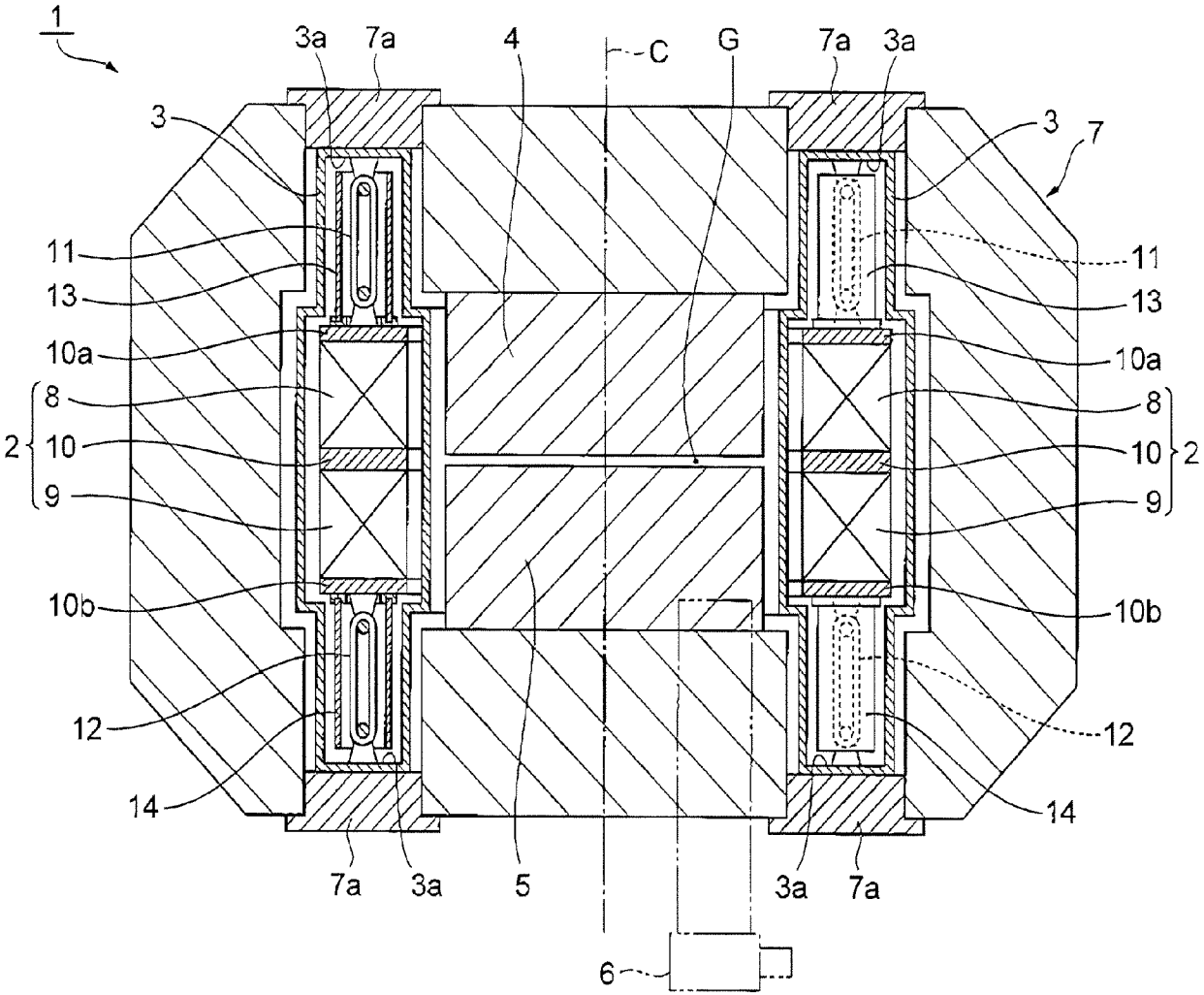
FIG. 1 is a schematic cross-sectional view illustrating a cyclotron related to one embodiment.

Meanwhile, in a case where the superconductive coil is employed in the cyclotron, when quenching occurs in which a superconductive state is abruptly broken for some reason, a large load is applied to the superconductive coil, and thus the support member of the superconductive coil is required to have a sufficient strength. However, if the strength is increased using a method such as merely increasing a diameter of the support member, there is a problem in that the heat transfer area of the support member increases, and thus the heat is easily transferred from outside.

It is desirable to provide a cyclotron capable of appropriately supporting a superconductive coil even in a case where quenching occurs and reducing the heat transfer area of a support member.

In the cyclotron related to the embodiment of the present invention, when a load is applied to the superconductive coil in the vacuum vessel due to quenching and thus the superconductive coil is moved (the superconductive coil is moved toward the support member for quenching side), the support member for quenching comes into contact with both of the superconductive coil and the vacuum vessel and functions as a supporter, and thereby it is possible to appropriately support the superconductive coil. In addition, according to the cyclotron, since the support member for quenching forms a predetermined gap with either one of the vacuum vessel and the superconductive coil in a normal state (superconductive state), it is possible to prevent external heat from being transferred to the superconductive coil via the support member for quenching. Further, in the cyclotron, since it is not necessary for the basic support member to support all loads generated due to quenching, it is possible to reduce the heat transfer area in a normal state (superconductive state) by miniaturizing the basic support member to that extent. Therefore, according to the cyclotron, it is possible to appropriately support the superconductive coil even in a case where quenching occurs and to reduce the heat transfer area of the basic support member.

In the cyclotron related to the embodiment of the present invention, the support member for quenching may be fixed to the superconductive coil and may form a predetermined gap with the vacuum vessel.

According to the cyclotron, it is possible to prevent external heat from being transferred to the support member for quenching in a normal state (superconductive state) and to thereby suppress the heat from being transferred to the superconductive coil via the support member for quenching as compared with a case where the support member for quenching is fixed to the vacuum vessel. In other words, when the support member for quenching with large heat capacity is fixed on a high temperature side (the vacuum vessel side), heat is transferred from the support member for quenching to the superconductive coil through radiation. Therefore, the support member for quenching is fixed to the superconductive coil, and thereby it is possible to suppress heat from being transferred to the superconductive coil. This is advantageous in maintaining a superconductive state of the superconductive coil.

In the cyclotron related to the present invention, the support member for quenching may be a hollow member.

According to the cyclotron, it is possible to reduce the heat transfer area of the support member for quenching while securing the strength enough to support the superconductive coil as compared with a case where the support member for quenching is formed of a solid member.

In the cyclotron related to the embodiment of the present invention, the basic support member may be disposed inside the hollow support member for quenching.

According to the cyclotron, it is possible to reduce the number of hole portions for disposing the support members to be formed in the external yoke as compared with a case where the basic support member and the support member for quenching are disposed separately from each other. Therefore, according to the cyclotron, it is possible to reduce processing costs of the yoke. In addition, it is possible to increase a degree of freedom of design of a cyclotron.

In the cyclotron related to the embodiment of the present invention, the basic support member may be a tension type support member which includes a first hook part fixed to the vacuum vessel side, a second hook part fixed to the superconductive coil side, and an annular body hooked on the first hook part and the second hook part.

According to the cyclotron, it is possible to easily install the basic support member (the tension type support member) as compared with a case of employing a basic support member with a rod shape or a string shape.

Hereinafter, embodiments of the present invention will be described in detail with reference to the drawings. In addition, identical or corresponding portions are given the same reference numeral in the respective drawings, and repeated description will be omitted.

One Embodiment

A cyclotron 1 of one embodiment shown in FIG. 1 is a circular accelerator which accelerates charged particles supplied from an ion source (not shown) so as to output charged particle rays (charged particle beams). The charged particles may include, for example, protons, baryons (heavy ions), electrons, or the like.

The cyclotron 1 includes a toric superconductive coil body 2 disposed with respect to a central axis C, a toric vacuum vessel 3 accommodating the superconductive coil body 2, an upper pole (upper magnetic pole) 4 and a lower pole (lower magnetic pole) 5 disposed in an empty core portion of the superconductive coil body 2, a refrigerator (cooling means) 6 for cooling the superconductive coil body 2, and a yoke 7. The yoke 7 is a hollow disk-shaped block, and includes the vacuum vessel 3, the upper pole 4, and the lower pole 5 disposed therein.

In addition, in this example, a description will be made of a case where the cyclotron 1 is disposed in a posture in which the central axis C extends vertically (horizontally disposed posture), but, for example, the cyclotron 1 may be disposed in a posture in which the central axis C extends horizontally (vertically disposed posture). In other words, the term "upper and lower, and left and right" in the description is not intended to limit a direction in which a member is disposed, "upper and lower" and "left and right" may be replaced with each other. For example, the upper pole 4 and the lower pole 5 may be expressed by a left pole or a right pole in a case of a cyclotron in a vertically disposed posture.

In the cyclotron 1, inside of the vacuum vessel 3 is made to be vacuum, and a current flows through the superconductive coil body 2 which is turned into a superconductive state by the refrigerator 6, thereby forming a strong magnetic field. A pair of dee electrodes (acceleration electrode) (not shown) is disposed in a space G between the upper pole 4 and the lower pole 5, and charged particles supplied from the ion source are accelerated by functions of the upper pole 4, the lower pole 5, and the dee electrodes, and are output as charged particle rays.

The superconductive coil body 2 has two superconductive coils 8 and 9, and a coil support member 10. The superconductive coils 8 and 9 are disposed so as to be arranged with respect to the central axis C, and are integrally supported by the coil support member 10 made of metal.

The coil support member 10 has an upper flange 10*a* which covers the upper surface of the upper superconductive coil 8, and a lower flange 10*b* which covers the lower surface of the lower superconductive coil 9. The upper flange 10*a* is located at the upper end of the superconductive coil body 2, and the lower flange 10*b* is located at the lower end of the superconductive coil body 2.

A part of the refrigerator 6 comes into contact with the lower flange 10*b*, and thus the superconductive coil body 2 is directly cooled. As the refrigerator 6, for example, a small GM refrigerator may be used.

The superconductive coil body 2 is supported by tension type support members (basic support members) 11 and 12. The first tension type support member 11 is a support member which is provided between an inner surface 3*a* of the vacuum vessel 3 and the upper flange 10*a* of the superconductive coil body 2. The second tension type support member 12 is a support member which is provided between the inner surface 3*a* of the vacuum vessel 3 and the lower flange 10*b* of the superconductive coil body 2.

The first tension type support member 11 and the second tension type support member 12 form a pair of support members and are disposed with the superconductive coil body 2 interposed therebetween, and pull the superconductive coil body 2 in directions opposite to each other so as to hold a position of the superconductive coil body 2. In addition, the number or an arrangement of the first tension type support member 11 and the second tension type support member 12 is not particularly limited, and may be appropriately selected depending on the size of the cyclotron 1 or other design matters.

Figure 2:
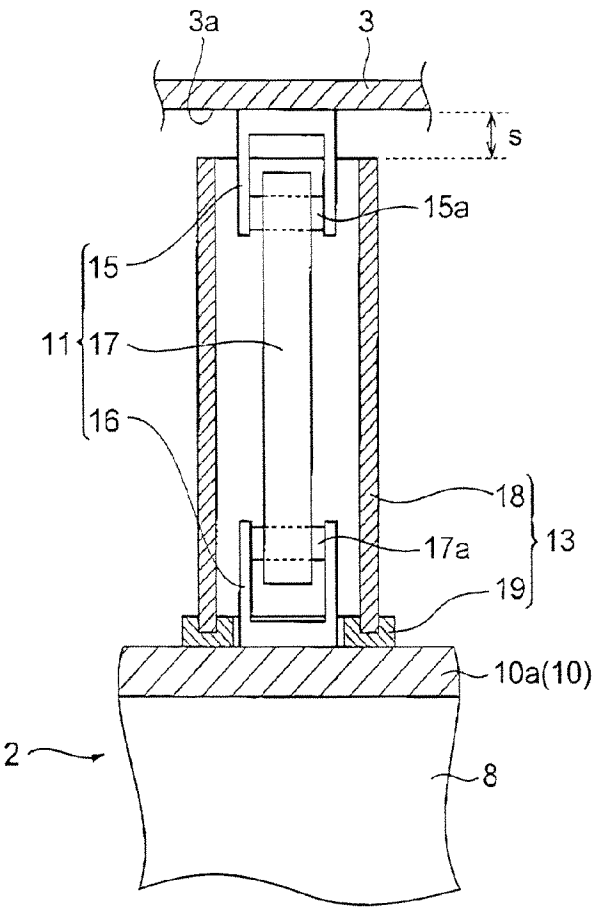
FIG. 2(*a*) is a side view illustrating a tension type support member, and FIG. 2(*b*) is a front view illustrating the tension type support member.
Figure 2:
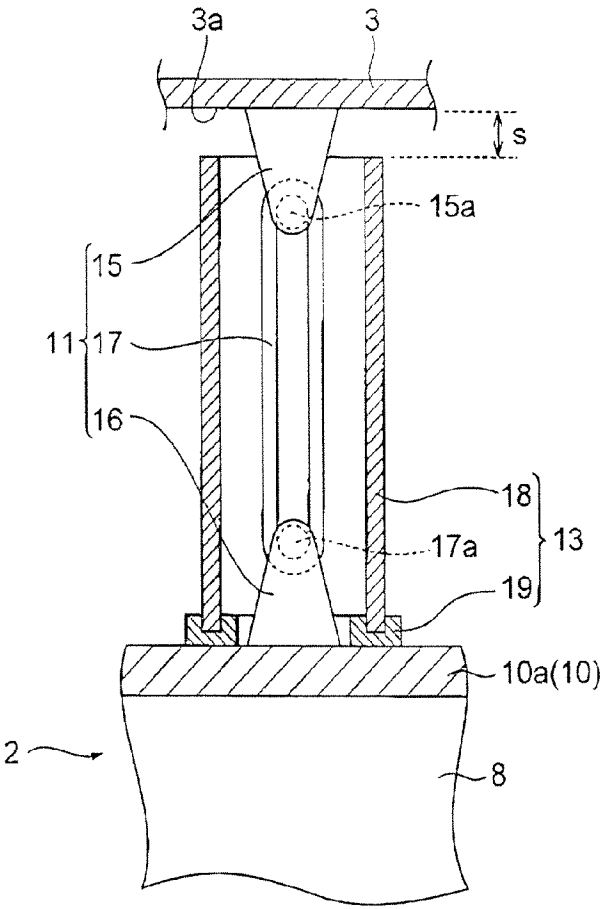

Here, FIGS. 2A and 2B are diagrams illustrating the first tension type support member 11. The first tension type support member 11 will be described with reference to FIGS. 2A and 2B. In addition, a configuration of the second tension type support member 12 is the same as that of the first tension type support member 11, and description thereof will be omitted.

As shown in FIGS. 2A and 2B, the first tension type support member 11 includes a first hook part 15 fixed to the inner surface 3*a* of the vacuum vessel 3, a second hook part 16 fixed to the upper flange 10*a*, and an annular body 17 which is hooked on the first hook part 15 and the second hook part 16.

The first hook part 15 is a member made of metal having a shaft 15*a* on which the annular body 17 can be hooked. The first hook part 15 is fixed to the vacuum vessel 3 by a screw or the like. Similarly, the second hook part 16 is a member made of metal having a shaft 16*a* on which the annular body 17 can be hooked, and is fixed to the upper flange 10*a* of the superconductive coil body 2 by a screw or the like.

The annular body 17 is a belt-shaped member made of Fiber Reinforced Plastics (FRP). The annular body 17 is hung on the shaft 15*a* of the first hook part 15 and the shaft 16*a* of the second hook part 16, and receives a tensile load applied to the vacuum vessel 3 and the upper flange 10*a* of the superconductive coil body 2.

The annular body 17 is formed so as to have a sufficient strength for supporting the weight of the superconductive coil body 2. On the other hand, the annular body 17 has elasticity which can allow the superconductive coil body 2 to slightly move in a case where quenching occurs. The annular body 17 with the elasticity allows a contraction amount (a displacement amount due to the contraction of the superconductive coil body 2) when the superconductive coil body 2 is contracted in a process of being cooled from a room temperature to a very low temperature. As the FRP forming the annular body 17, Glass Fiber Reinforced Plastics (GFRP) or Carbon Fiber Reinforced Plastics (CFRP) may be used, and FRP with low heat conductivity may be used.

In addition, a block body 7*a* forming a part of the yoke 7 is disposed on the back side of the surface to which the first hook part 15 is fixed in the vacuum vessel 3. The block body 7*a* is disposed so as to suppress outside of the vacuum vessel 3, and reinforces the portion to which the first hook part 15 is fixed in the vacuum vessel 3.

As shown in FIG. 1, support members 13 and 14 for quenching are provided on the upper and lower sides of the superconductive coil body 2. The support members 13 and 14 for quenching are members for receiving a load occurring in the superconductive coil body 2 when quenching occurs. In addition, a cross-section of the support members 13 and 14 for quenching is shown on the left part of FIG. 1, and a side surface of the support members 13 and 14 for quenching are shown on the right part thereof.

The first support member 13 for quenching is fixed to the upper flange 10*a* of the superconductive coil body 2, and the second support member 14 for quenching is fixed to the lower flange 10*b* of the superconductive coil body 2.

The first support member 13 for quenching and the second support member 14 for quenching are hollow cylindrical members. The first support member 13 for quenching and the second support member 14 for quenching are disposed so as to respectively surround the tension type support members 11 and 12. Specifically, the first tension type support member 11 is disposed inside the cylindrical first support member 13 for quenching, and the second tension type support member 12 is disposed inside the cylindrical second support member 14 for quenching.

The tension type support members 11 and 12 and the support members 13 and 14 for quenching are respectively provided in fours at the interval of 90 degrees around the central axis C, for example, on the upper surface or the lower surface of the superconductive coil body 2.

Here, the first support member 13 for quenching will be described with reference to FIGS. 2A and 2B. In addition, a configuration of the second support member 14 for quenching is the same as that of the first support member 13 for quenching, and description thereof will be omitted.

As shown in FIGS. 2A and 2B, the first support member 13 for quenching has a cylindrical main body part 18 and a fixing part 19 which fixes the main body part 18. The fixing part 19 is an annular member made of metal, and is fixed to the upper flange 10*a* of the superconductive coil body 2 by a screw or the like.

The cylindrical main body part 18 is made of, for example, FRP, and vertically extends along the first tension type support member 11. A base end side of the main body part 18 is fixed to the superconductive coil body 2 via the fixing part 19.

On the other hand, a front end side (the inner surface 3*a* side of the vacuum vessel 3) of the main body part 18 is a free end which does not come into contact with any member in a normal state (superconductive state) . Specifically, the main body part 18 is disposed such that the front end side thereof forms a predetermined gap S with the inner surface 3*a* of the vacuum vessel 3. The interval of the predetermined gap S is, for example, 0.5 mm to 1.5 mm. In addition, the main body part 18 is disposed so as to also form a predetermined gap in the transverse direction.

The main body part 18 has a strength enough to support a load applied to the superconductive coil body 2 when quenching occurs.

According to the above-described cyclotron 1 related to one embodiment, when a load is applied to the superconductive coil body 2 in the vacuum vessel 3 due to quenching and thus the superconductive coil body 2 is moved (the superconductive coil body 2 is moved upward or downward in FIG. 1), either one of the support members 13 and 14 for quenching comes into contact with both of the superconductive coil body 2 and the vacuum vessel 3 and functions as a supporter, and thereby it is possible to appropriately support the superconductive coil body 2. In addition, according to the cyclotron 1, since the support members 13 and 14 for quenching form the predetermined gap S with the inner surface 3*a* of the vacuum vessel 3 in a normal state (superconductive state), it is possible to prevent external heat from being transferred to the superconductive coil body 2 via the support members 13 and 14 for quenching.

In addition, in the cyclotron 1, since it is not necessary for the tension type support members 11 and 12 to support all loads generated due to quenching, it is possible to reduce the heat transfer area in a normal state (superconductive state) by miniaturizing the tension type support members 11 and 12, or the like. Therefore, according to the cyclotron 1, it is possible to appropriately support the superconductive coil body 2 even in a case where quenching occurs and to reduce the heat transfer area of the tension type support members 11 and 12.

Further, since the support members 13 and 14 for quenching are fixed to the superconductive coil body 2 in the cyclotron 1, it is possible to prevent external heat from being transferred to the support members 13 and 14 for quenching in a normal state (superconductive state) and to thereby suppress the heat from being transferred to the superconductive coil body 2 via the support members 13 and 14 for quenching as compared with a case where the support members 13 and 14 for quenching are fixed to the vacuum vessel 3 and are spaced apart from the superconductive coil body 2. In other words, when the support members 13 and 14 for quenching with large heat capacity are fixed on the high temperature side (the vacuum vessel side), heat is transferred from the support members 13 and 14 for quenching to the superconductive coil body 2 through radiation. Therefore, the support members 13 and 14 for quenching are fixed to the superconductive coil body 2, and thereby it is possible to suppress heat from being transferred to the superconductive coil body 2. This is advantageous in maintaining a superconductive state of the superconductive coil body 2.

In addition, in the cyclotron 1, since the support members 13 and 14 for quenching are formed of hollow members, it is possible to reduce the heat transfer area of the support member and secure the strength as compared with a case of using a solid member.

In addition, in the cyclotron 1, since the tension type support members 11 and 12 are disposed inside the hollow support members 13 and 14 for quenching, it is possible to reduce the number of hole portions for disposing the support members to be formed in the yoke as compared with a case where the tension type support members 11 and 12 and the support members 13 and 14 for quenching are disposed separately from each other. Therefore, according to the cyclotron 1, it is possible to reduce processing costs of the yoke 7. In addition, it is possible to increase a degree of freedom of the design of a cyclotron.

Further, in the cyclotron 1, since the tension type support member 11 includes the first hook part 15, the second hook part 16, and the annular body 17, it is possible to easily install the tension type support member 11 as compared with a case of employing a configuration of a rod shape or a string shape. In addition, this is also the same for the tension type support member 12 having the same configuration.

Another Embodiment

Figure 3:
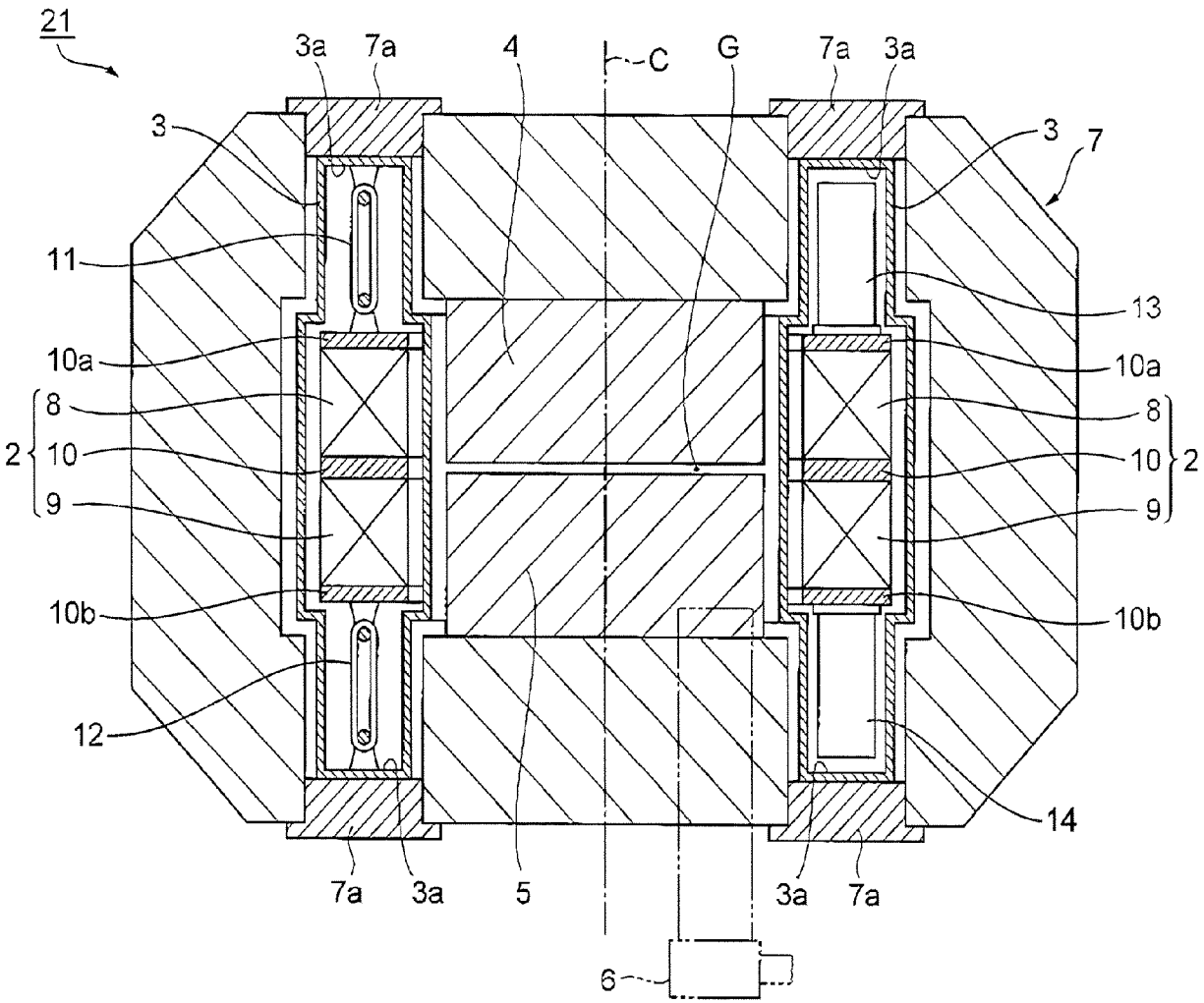
FIG. 3 is a schematic cross-sectional view illustrating a cyclotron related to another embodiment.

A cyclotron 21 related to another embodiment shown in FIG. 3 is only different from the cyclotron 1 related to one embodiment in that the tension type support members 11 and 12 and the support members 13 and 14 for quenching are disposed separately from each other.

In the cyclotron 21, the tension type support members 11 and 12 are not disposed inside the cylindrical support members 13 and 14 for quenching and are respectively disposed at different positions. In other words, the tension type support members 11 and 12 and the support members 13 and 14 for quenching respectively have dedicated spaces.

According to the cyclotron 21 related to another embodiment, there is no interference between the tension type support members 11 and 12 and the support members 13 and 14 for quenching. Therefore, in the cyclotron 21, choices for shapes or sizes of the tension type support members 11 and 12 and the support members 13 and 14 for quenching can be widened, and thus it is possible to increase a degree of freedom of design of a cyclotron.

The present invention is not limited to the above-described embodiments. For example, the number of superconductive coils is not necessarily two, and may be one or three or more. Further, the shape and configuration of the vacuum vessel or the yoke are only an example, and is not limited to the above-described aspect.

In addition, the cyclotron is not necessarily disposed in a horizontally disposed posture in which the central axis C extends vertically. For example, the cyclotron may be disposed in a vertically disposed posture in which the central axis C extends horizontally.

The tension type support member does not necessarily have a form including an annular body, and may have a rod shape or a string shape. In addition, the tension type support members are not necessarily formed in a pair of upper and lower members, and may be disposed at positions which do not corresponds to each other in the vertical direction. Furthermore, a member which supports the superconductive coil from the transverse direction may be further provided. Further, the basic support member disclosed in the claims is not necessarily a tension type support member, and may be a support member made of, for example, a bar or other rigid bodies.

The support members for quenching are not necessarily fixed to the superconductive coil side, and may have an aspect in which they are fixed to the vacuum vessel side and form a predetermined gap with the superconductive coil side. In addition, the support members for quenching are also not necessarily formed in a pair of upper and lower members, and may be disposed at positions which do not corresponds to each other in the vertical direction.

Further, the support members for quenching are not limited to a cylindrical shape, and may have a rectangular shape, a polygonal shape, other tubular shapes, and the like, or may be a plate-shaped member having a C shape in a cross-section or other bends. In addition, in a case where the support members for quenching are disposed separately from the tension type support members, a solid member may be employed.

It should be understood that the invention is not limited to the above-described embodiment, but may be modified into various forms on the basis of the spirit of the invention. Additionally, the modifications are included in the scope of the invention.

What is claimed is:

1. A cyclotron comprising:

a superconductive coil that is disposed in a vacuum vessel;

a cooling unit that cools the superconductive coil;

a basic support member that is installed in the vacuum vessel and supports the superconductive coil in the vacuum vessel; and a support member for quenching that is fixed to one of the superconductive coil and the vacuum vessel and forms a predetermined gap with the other thereof.

2. The cyclotron according to claim 1, wherein the support member for quenching is fixed to the superconductive coil and forms a predetermined gap with the vacuum vessel.

3. The cyclotron according to claim 2, wherein the support member for quenching is a hollow member.

4. The cyclotron according to claim 3, wherein the basic support member is disposed inside the hollow support member for quenching.

5. The cyclotron according to any one of claim 4, wherein the basic support member is a tension type support member which includes a first hook part fixed to the vacuum vessel side, a second hook part fixed to the superconductive coil side, and an annular body hooked on the first hook part and the second hook part.

* * * * *